US007098452B2

(12) United States Patent
Schneider et al.

(10) Patent No.: US 7,098,452 B2
(45) Date of Patent: Aug. 29, 2006

(54) ATMOSPHERIC PRESSURE CHARGED PARTICLE DISCRIMINATOR FOR MASS SPECTROMETRY

(75) Inventors: Bradley Schneider, Bradford (CA); Thomas R. Covey, Richmond Hill (CA)

(73) Assignee: MDS Sciex, Concord (CA)

( * ) Notice: Subject to any disclaimer, the term of this patent is extended or adjusted under 35 U.S.C. 154(b) by 0 days.

(21) Appl. No.: 10/778,424

(22) Filed: Feb. 13, 2004

(65) Prior Publication Data

US 2004/0217280 A1 Nov. 4, 2004

Related U.S. Application Data

(60) Provisional application No. 60/447,655, filed on Feb. 14, 2003.

(51) Int. Cl.
*H01J 49/04* (2006.01)

(52) U.S. Cl. ..... 250/288

(58) Field of Classification Search ..... 250/288
See application file for complete search history.

(56) References Cited

U.S. PATENT DOCUMENTS

| | | | | |
|---|---|---|---|---|
| 4,023,398 | A | 5/1977 | French et al. | |
| 4,531,056 | A | 7/1985 | Labowsky et al. | |
| 4,842,701 | A | 6/1989 | Smith et al. | |
| 4,861,988 | A | 8/1989 | Henion et al. | |
| 4,885,076 | A | 12/1989 | Smith et al. | |
| 4,977,320 | A | 12/1990 | Chowdhury et al. | |
| 5,015,845 | A | 5/1991 | Allen et al. | |
| 5,103,093 | A | 4/1992 | Sakairi et al. | |
| 5,171,990 | A | 12/1992 | Mylchreest et al. | |
| 5,270,542 | A | 12/1993 | McMurry et al. | |
| 5,298,744 | A | 3/1994 | Mimura et al. | |
| 5,304,798 | A | 4/1994 | Tomany et al. | |
| 5,313,061 | A | 5/1994 | Drew et al. | |
| 5,353,892 | A | 10/1994 | Lu | |
| 5,412,208 | A | 5/1995 | Covey et al. | |
| RE35,413 | E | 12/1996 | Mylchreest et al. | |
| 5,756,994 | A | 5/1998 | Bajic | |
| 6,124,675 | A | 9/2000 | Bertrand et al. | |
| 6,177,669 | B1 * | 1/2001 | Wells et al. | 250/288 |
| 6,339,218 | B1 * | 1/2002 | Kato et al. | 250/288 |
| 6,462,336 | B1 | 10/2002 | Bajic | |
| 6,700,119 | B1 | 3/2004 | Giles | |
| 2004/0262512 | A1 * | 12/2004 | Tobita et al. | 250/288 |

FOREIGN PATENT DOCUMENTS

| | | |
|---|---|---|
| EP | 0 622 830 A1 | 11/1994 |
| EP | 1 193 730 A1 | 4/2002 |
| GB | 2 324 906 A | 11/1998 |
| JP | 11-108894 | 4/1999 |
| JP | 2000-55880 | 2/2000 |

OTHER PUBLICATIONS

Zubarev et al., *Electron Capture Dissociation of Multiply Charged Protein Cations. A Nonergodic Process:* 1998 American Chemical Society, 120, 3265–3266.

(Continued)

*Primary Examiner*—Jack I. Berman
(74) *Attorney, Agent, or Firm*—Leydig, Voit & Mayer, Ltd.

(57) ABSTRACT

An apparatus and method for performing mass spectroscopy uses an ion interface to provide the function of removing undesirable particulates from an ion stream from an atmospheric pressure ion source, such as an electrospray source or a MALDI source, before the ion stream enters a vacuum chamber containing the mass spectrometer. The ion interface includes an entrance cell with a bore that may be heated for desolvating charged droplets when the ion source is an electrospray source, and a particle discrimination cell with a bore disposed downstream of the bore of the entrance cell and before an aperture leading to the vacuum chamber. The particle discrimination cell creates gas dynamic and electric field conditions that enables separation of undesirable charged particulates from the ion stream.

23 Claims, 9 Drawing Sheets

OTHER PUBLICATIONS

Lee et al., *Thermally Assisted Electrospray Interface for Liquid Chromatography/Mass Spectrometry;* Rapid Communications in Mass Spectrometry, vol. 6, 727–733 (1992).
Herron et al., *Reactions of Polyatomic Dianions with Cations in the Paul Trap,* Rapid Communications in Mass Spectrometry, vol. 10, 277–281 (1996).
Schneider et al., *Atmospheric Pressure Charged Particle Discrimination Interface for Low Flow Rate* ESI–MS –ASMS Abstract.
Schneider et al., *Particle Discriminator Interface for Nanoflow ESI–MS* 2003 American Society for Mass Spectrometry.

Niessen, "Advances in instrumentation in liquid chromatography–mass spectrometry and related liquid–introduction techniques," *Journal of Chromatography A.* 794 (1998) pp. 407–435.

* cited by examiner

ATMOSPHERIC PRESSURE CHARGED PARTICLE DISCRIMINATOR FOR MASS SPECTROMETRY

CROSS-REFERENCE TO RELATED PATENT APPLICATION

This application claims the priority of U.S. Provisional Application 60/447,655, filed Feb. 14, 2003.

FIELD OF THE INVENTION

This invention relates to mass spectrometry, and more particularly to the interface between an atmospheric pressure ion source and low pressure regions of a mass spectrometer.

BACKGROUND OF THE INVENTION

Samples or analytes for analysis in mass spectrometers are often ionized in an atmospheric environment, and the ions are then introduced into a vacuum chamber that contains the mass spectrometer. An atmospheric pressure ion source provides advantages in handling of samples, but the introduction of ions from the ion source into the vacuum chamber often requires a proper interface disposed between the ion source and the vacuum chamber. For instance, one common family of ionization techniques includes electrospray and its derivatives, such as nanospray, which provides a low flow. In all such techniques, a liquid sample, containing the desired analyte in a solvent, is caused to form a spray of charged and neutral droplets at the tip of an electrospray capillary. Once the spray is produced, the solvent begins to evaporate and is removed from the droplet, which is a process commonly referred to as desolvation. Accordingly, an important step in generating ions is to ensure proper desolvation. The electrospray source is usually coupled with some means of desolvation in an atmospheric pressure chamber, where desolvation can be enhanced by heat transfer to the droplets (radiation, convection) or/and countercurrent flow of dry gas. The spray generally consists of a distribution of droplet sizes, and subsequently, the degree of desolvation will be different for each droplet size. Consequently, after desolvation, there is a size distribution for desolvated particles where there are large and heavy charged particles that may contaminate the aperture or conductance limit, thereby preventing the long-term stable operation of the mass analysis region, and/or introducing additional noise to the ion detector. This additional source of noise reduces the signal to nose ratio and thus, the sensitivity of the mass spectrometer.

The ions and the accompanying solvent molecules (neutrals) and charged particles, are transferred from the atmospheric pressure region to the low-pressure chamber of the mass spectrometer. Generally, the mass spectrometer operates less than $10^{-4}$ Torr and requires stages of skimmers or apertures to provide step-wise pressure reduction. Various methods for allowing the ions to enter while preventing the neutrals from passing into the mass spectrometer are well known. In U.S. Pat. No. 4,023,398, assigned to the assignee of the present invention and the contents incorporated here, as represented in FIG. 9, the mass spectrometer 32 is coupled to atmosphere by the interface region 15. A partition 3 with an entrance aperture 4 is provided to separate the atmospheric pressure from the first vacuum or lower pressure region 10 of the mass spectrometer 32 and a curtain gas 7 is supplied to prevent surrounding gases and neutrals 14 from entering the vacuum regions 10 & 11. The diameter of the entrance aperture 4 is chosen to limit the gas flow from the atmospheric region in order to balance the pumping capacity of the first and subsequent vacuum pumps 12 and 13 in the mass spectrometer region 32. A curtain plate 5 with an orifice 6 is located between the entrance aperture 4 and the spray 2. The purpose of the curtain plate 5 is to apply a flow of curtain gas 7 in the reverse direction of the spray 2. The curtain gas 7 has two functions: to divert the neutrals 14 from entering the aperture 4 and to desolvate the charge droplets so to release ions. In this method, charged particulates and heavy charged droplets that are not fully desolvated and remain as residual charged droplets may pass through the curtain gas flow and continue to travel downstream towards the entrance aperture 4.

U.S. Pat. Nos. 4,977,320, and 5,298,744, teach a method whereby a heated tube made from conductive or non-conductive material is used for delivering the ions/gas carrier/solvent flow into the low-pressure chamber. In such a configuration, the heated tube provides two distinct and separate functions; firstly, due to its significant resistance to gas flow, the tube configuration, namely its length and inner diameter, adjusts the gas load on the pumping system; secondly, the tube can be heated to effect desolvation and separation of ions from neutrals. With respect to the first function, this resistance can be provided, while keeping the tube length constant, to ensure laminar gas flow in the tube and the widest possible opening for inhaling the ion/gas carrier/solvent flow. Generally, a wider bore for the tube provides increased gas flow and hence more load on the pumping system; correspondingly, reducing the tube length provides less resistance to the gas flow, so as also to increase the gas flow and load on the pumping system. These two geometric parameters, bore and length, are obviously related and can be adjusted to provide the desired flow rate and flow resistance. The second function is provided by mounting a heater around the interface tube. The heat provided to the tube promotes desolvation of the ion flow, and also helps to reduce contamination of the surface of the tube, thereby reducing memory effects. An interface of this type is able to work best under strictly laminar flow conditions, limiting the variability of the tube length and tube bore. Additionally, the desolvation, which depends on temperature and residence time (inversely proportional to gas velocity through the tube) is related to the pumping requirements. As a rule, it is not possible to optimize all the desired parameters; in particular, it is desirable to minimize total mass flow to reduce pumping requirements, on the other hand to ensure best efficiency for transfer of ions into the mass spectrometer, a large diameter tube with high mass flow rates is desirable. In addition, the desolvation of ions is also affected by the diameter of the tube due to changes in residence time.

U.S. Pat. No. 5,304,798 attempts to satisfy both of these requirements by teaching a method whereby a chamber has a contoured passageway to provide both the desolvation function and the capillary restriction function. The opening of the passageway adjacent to atmospheric pressure has a wide and long bore while the opposite end of the passageway, ending within the vacuum chamber, has a smaller shorter bore. The electrospray source is place in front of the opening of the wide bore allowing the spray to pass directly into the passageway. The desolvation is performed within the wide bore region while the smaller bore provides the mass flow restriction. The entire spray is passed into the desolvation tube and any neutral or charged particulates or droplets not fully desolvated, will pass into the small bore. These particulates or droplets can accumulate in the small bore, which may cause blockage or they may pass through the small bore and enter the vacuum chamber leading to extensive contamination.

U.S. Pat. No. Re. 35,413 describes a desolvation tube and a skimmer arrangement where the exit of the desolvation tube is positioned off-axis to the skimmer. Offsetting the axis of the tube from the orifice of the skimmer is intended to allow the ions to flow through the orifice while the undesolvated droplets and particulates impinge upon the skimmer. This method does not take into consideration that the undesolvated droplets or charged particles, are not restricted to travel along the axis of the desolvation tube but follow a distribution across the bore. That is, this arrangement will only prevent undesolvated droplets and particulates traveling along the central axis from entering the orifice. An offset of the desolvation tube will not prevent droplets and charged particulates aligned with the offset location from entering the skimmer or to prevent an accumulation from building up around the orifice. In addition, it is expected that there would be a reduction of the ion current through the skimmer as a function of the offset.

In U.S. Pat. No. 5,756,994, a heated entrance chamber is provided, and is pumped separately. Ions entering this chamber through an entrance aperture are then sampled through an exit aperture that is located in the side of the chamber, off any line representing a linear trajectory from the entrance orifice. The intention of this off alignment is to prevent the neutral droplets or particles from entering the exit aperture. Pressure in this heated entrance chamber is maintained around 100 Torr. To the extent that this is understood, there is an independent pumping arrangement in the entrance chamber, and the shape of the chamber is not conducive to maintaining laminar flow, with the entrance aperture being much smaller than the cross-section of the main portion of the chamber itself. It is expected that significant loss of ion current to the walls of this chamber would occur in addition to obvious inefficiency of sampling from only one point of cylindrical flow through the exit aperture.

Another common type of atmospheric pressure ion sources uses the matrix-assisted laser desorption/ionization (MALDI) technique. In such a source, photon pulses from a laser strike a target and desorb ions that are to be measured in the mass spectrometer. The target material is composed of a low concentration of analyte molecules, which usually exhibit only moderate photon absorption per molecule, embedded in a solid or liquid matrix consisting of small, highly-absorbing species. The sudden influx of energy in the laser pulse is absorbed by the matrix molecules, causing them to vaporize and to produce a small supersonic jet of matrix molecules and ions in which the analyte molecules are entrained. During this ejection process, some of the energy absorbed by the matrix is transferred to the analyte molecules, thereby ionizing the analyte molecules. The plume of ions generated by each laser pulse contains not only the analyte ions but also charged particulates containing the matrix material, which may affect the performance of the mass spectrometer if not removed from the ion stream.

SUMMARY OF THE INVENTION

In view of the forgoing, the present invention provides a system for preparing ions to be studied by an ion mass spectrometer. The system has an atmospheric pressure ion source, such as an electrospray ion source or a MALDI source, a mass spectrometer contained in a vacuum chamber, and an interface for introducing ions from the ion source into the vacuum chamber. The interface includes an entrance cell and a particle discrimination cell.

In an embodiment where the atmospheric pressure ion source is an electrospray ion source, the entrance cell may function as a desolvation cell. The electrospray ion source operates in the atmosphere and provides a spray of charged droplets that contain ions to be studied. The spray is directed into a heated bore of the desolvation cell for drying the droplets in the spray to generate an ion stream, which contains undesirable particulates. A particle discrimination cell for discriminating against (i.e., removing) particulates is disposed downstream of the desolvation cell and before an aperture in a partition that separate the atmospheric pressure from the vacuum in the vacuum chamber. The particle discrimination cell has a bore for receiving the ion stream that is larger than the bore of the desolvation cell and has a central zone and a discrimination zone surrounding the central zone. Eddies are formed in the discrimination zone when the ion stream flows into the bore of the particle discrimination cell. The particle discrimination cell has a voltage applied thereto for generating a particle discrimination electric field in its bore. The electric field and the formation of eddies in the particle discrimination cell together provide the effect of removing particulates from the ion stream so that they do not enter the aperture of the partition.

The present invention also provides a method of interfacing an ion source that operates in the atmosphere with an ion mass spectrometer in a vacuum chamber. The ion source may be, for instance, an electrospray source or a MALDI source. An interface that contains an entrance cell and a charged particle discrimination cell is disposed between the atmospheric ion source and the vacuum chamber. When the ion source is an electrospray source, the entrance cell is used as a desolvation cell. A spray of charged ion droplets generated by the ion source is directed into a heated bore of a desolvation cell for drying the droplets in the spray to generate an ion stream, which contains undesirable particulates. The ion stream then is directed through a discrimination cell that is disposed downstream of the desolvation cell and upstream of an aperture in a partition that separates the atmosphere from the vacuum chamber containing the ion mass spectrometer. The discrimination cell has a bore that is greater than the bore of the desolvation cell and has a central zone and a discrimination zone surrounding the central zone. While flowing from the desolvation cell into the discrimination cell, the ion stream generates eddies in the discrimination zone of the discrimination cell. A voltage is applied to the discrimination cell to generate a discrimination electric field in the bore of the discrimination cell. The electric field and generation of eddies in the discrimination cell together provide the effect of removing undesirable charged particulates from the ion stream so that they do not enter the aperture of the partition.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings, of which:

DETAILS OF THE EXEMPLIFYING EMBODIMENTS

Figure 1:
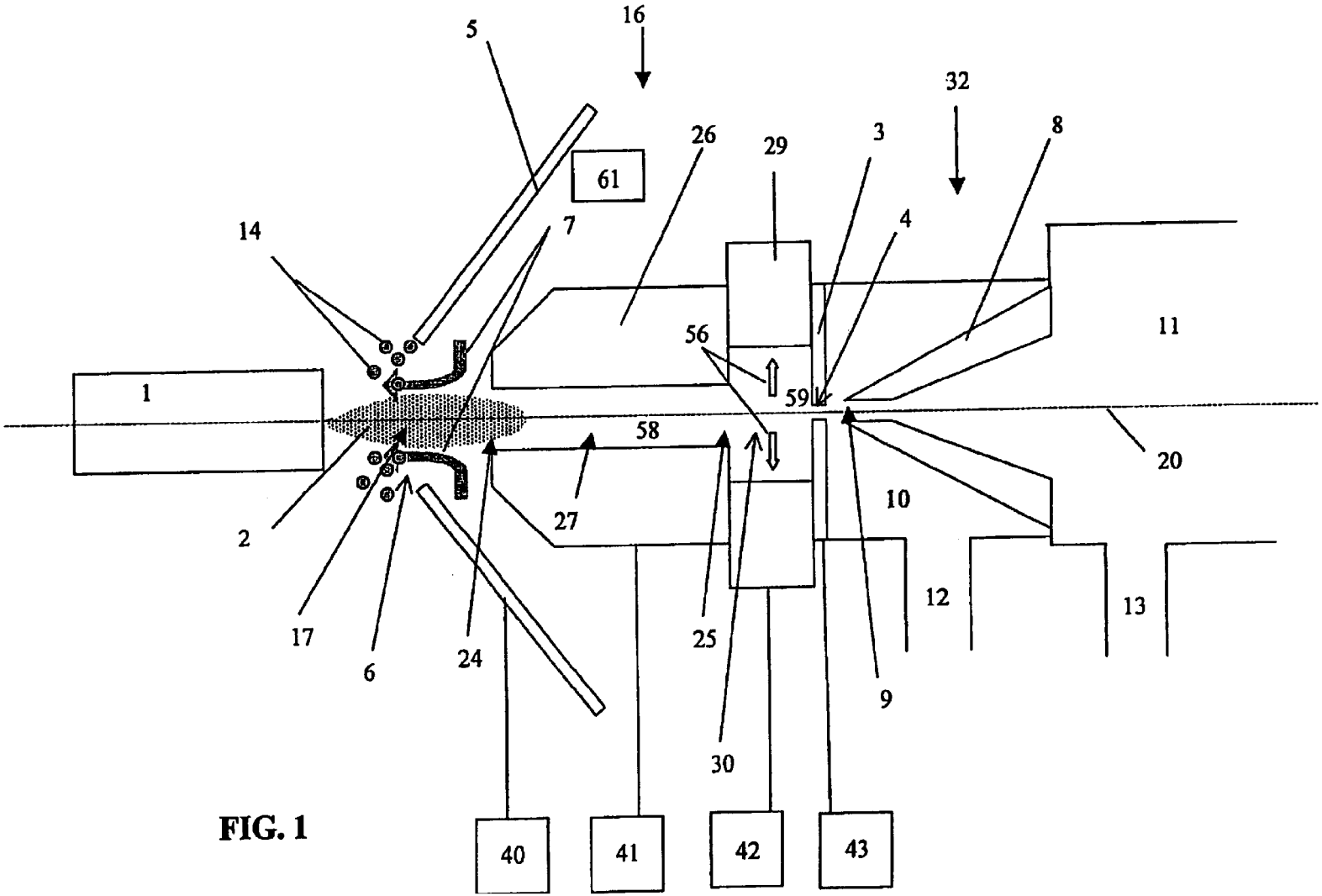
FIG. 1 is a schematic view of the charged particle discriminator in accordance with the present invention.

Referring now to the drawings, FIG. 1 is an illustration according to one embodiment of the present invention, which shows an atmospheric pressure interface generally indicated by 16. The interface 16 is positioned between an ion source 1 and the mass spectrometer 32, the interface 16 comprising of at least one interface cell, described as follows. Ions from the ion source 1 pass into the mass spectrometer 32 comprising of vacuum chambers 10 and 11 through apertures 4 and 9, respectively. The pressure in each of the vacuum chambers 10 and 11 is step-wise reduced by vacuum pumps 12 and 13, respectively. The aperture 9 mounted in the partition 8 between the vacuum stages restricts neutral gas conductance from one pumping stage to the next while the aperture 4 mounted in the partition 3 restricts the flow of gas from atmosphere into the vacuum chamber 10. The pressure between the aperture 4 and the ion source 1 is typically at or near atmospheric pressure.

The ion source 1 can be a single or a multiple of the many known types of ion sources depending on the type of sample to be analyzed. For instance, the ion source may be an electrospray or ion spray device, a corona discharge needle, a plasma ion source, an electron impact or chemical ionization source, a photo ionization source, a MALDI source, or any multiple combinations of the above. Other desired types of ion sources may be used, and the ion source may operate at atmospheric pressure, above atmospheric pressure, near atmospheric pressure, or in vacuum. Generally, the pressure in the ion source is greater than the pressure downstream in the mass spectrometer 32. The ion source 1 produces a spray (in the case of an electrospray source) or a plume (in the case of a MALDI ion source), or plurality of sprays or plumes. The spray from an electrospray ions source initially comprises mostly charged droplets followed by the progressive formation of ions and particulates. When a MALDI ion source is used, the plume from a MALDI ion source typically comprises a mixture of ions and particulates where the particulates can be hydrated or simply charged or neutral particles (depending on the degree of thermal heating from the MALDI laser). Regardless of the ion source type, the presence of either undesolvated droplets or particulates may degrade the quality of the ion stream and interfere with the transmission of the ions through the aperture 4 of the mass spectrometer 32. As described below, the ion interface of the present invention enables the removal of the undesirable particulates from the ion stream before the ions enter the vacuum chamber containing the mass spectrometer.

For simplicity of description, the following description describes an embodiment in which the ion source is an electrospray source. It will be appreciated, however, that the ion interface of the invention is also effective in removing undesirable charged particulates from the plumes of ions generated by a MALDI source. Still referring to FIG. 1, a spray 2 from an electrospray source comprises a mixture of ions, droplets and particulates directed towards a curtain flow region 17. The curtain flow region 17 is defined by the region in front of the inlet 24 to the entrance cell 27. The curtain plate 5 has an opening 6 positioned centered on the line defined by the axis 20, and curtain gas 7 supplied by gas source 61 flows in the curtain flow region 17 between the orifice 6 and the inlet 24 of the entrance cell 27. Depending on the type of ion source used, the gas source 61 can be adjusted to supply a range of flow rates including no flow at all.

Figure 2:
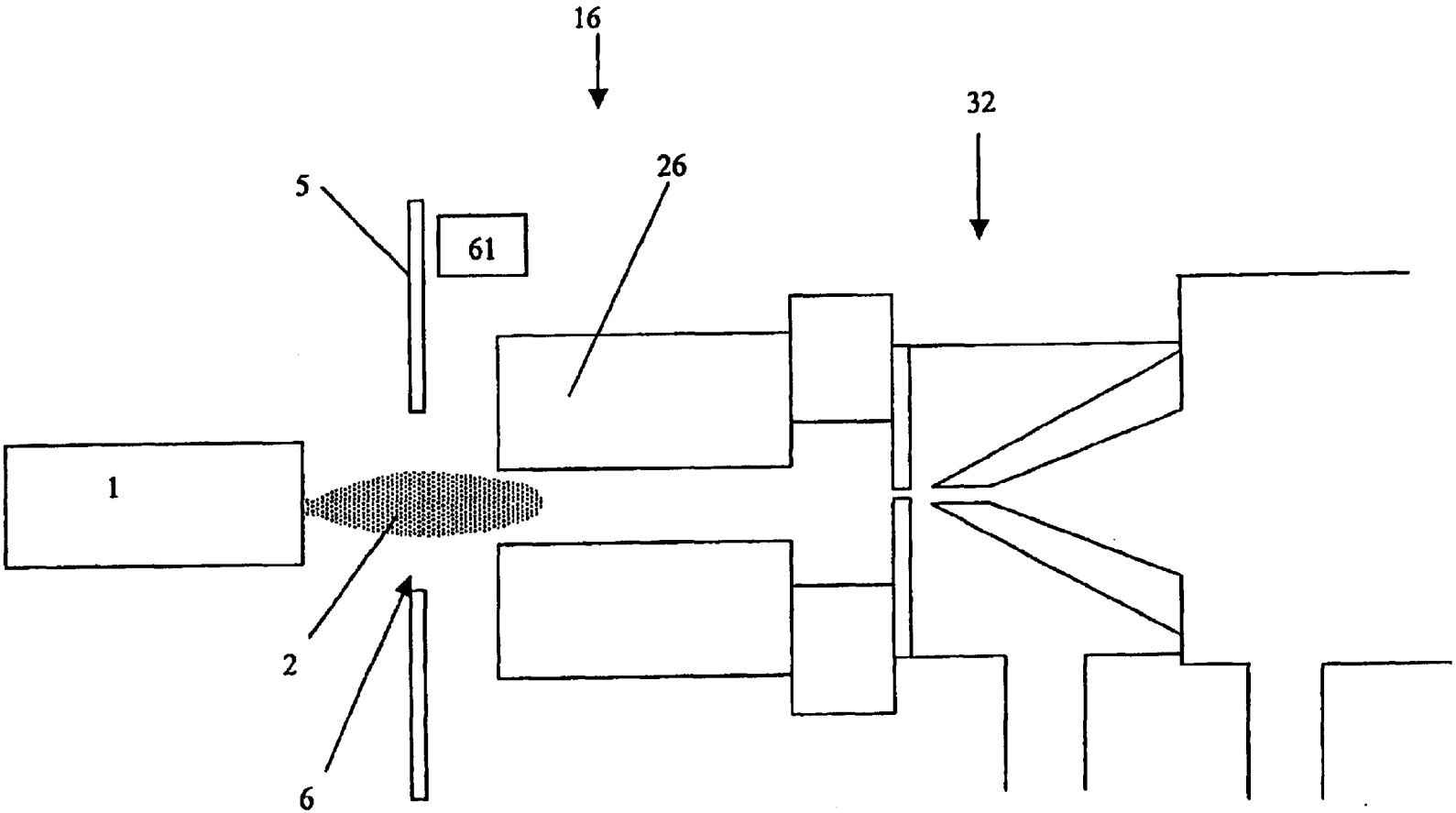
FIG. 2 is a schematic view of another charge particle discriminator in accordance with the present invention.

The curtain plate 5 can take the form of a conical surface as in FIG. 1, or a flat surface as shown in FIG. 2, a ring, or any other suitable configuration for directing the curtain gas 7 to the curtain flow region 17. In FIGS. 1 and 2, like numerals represent the like elements, but for clarity, some of the reference numbers have been omitted. Some of the curtain gas 7 will tend to flow into the inlet 24 as well as out through the orifice 6 in an opposing direction to the spray 2. When the spray 2 encounters the curtain gas 7, turbulent mixing occurs whereby the droplets desolvate and release ions. The curtain plate 5 and the curtain gas 7 can be heated to an elevated temperature (typically from 30 to 500° C.) to facilitate the desolvation process. As the ions continue to travel in a direction towards the mass spectrometer 32, neutral particulates and residual neutral droplets 14, collide with the curtain gas 7 or the general background gas and are prevented from entering the inlet 24. Thus, the neutral particulates and residual neutral droplets are discriminated from the remainder of the plume.

The ions, the charged particles, the residual charged droplets, and a portion of the curtain gas 7 flow into an entrance cell 27, which is located within a heated chamber 26, having a bore 58. When an electrospray source is used, the entrance cell is heated to help desolvate the charged droplets from the electrospray source. For this reason, the entrance cell 27 is also referred to as the desolvation cell in the following description. Secondary desolvation occurs, a result of the heated chamber 26 convectively transferring heat to the residual charged droplets. Ions are released from the desolvated droplets but those charged droplets that form charged particulates are permitted to flow through the desolvation cell 27. Subsequently, the ions and the charged particulates emerging from the heated chamber exit 25 travel into a second particle discriminator cell 30, located between the heated chamber exit 25 and the partition 3 and confined by the spacer 29 in the radial direction. The inner diameter of the spacer 29 is greater than the internal bore 58 of the heated chamber 26, which is greater than the aperture 4 of the partition 3. Typically, the aperture 4 has diameter between 0.10 to 1.0 mm with wall thickness between 0.5 to 1.0 mm, the spacer 29 has diameter between 2 to 20 mm and the bore 58 of the heated chamber 26 has diameter between 0.75–3 mm. The curtain plate 5, the heated chamber 26, the spacer 29 and the partition 3 are electrically isolated from each other by appropriately known methods, having one pole (depending on the polarity of the ions desired) of voltage sources 40, 41, 42 and 43 connected to them respectively. As is conventional, the voltage sources 40, 41, 42 and 43, are configured for direct current, alternating current, RF voltage, grounding or any combination thereof. The spacer 29 can be fabricated from a non-conductive material such as ceramic, in which no potential is applied. As indicated previously, the pressure between the partition 3 and ion source 1 is substantially atmospheric and as such, the mating surface between the heated chamber 26 to the spacer 29 and the mating surfaces between the spacer 29 to the partition 3 do not require vacuum tight seals. However, because a net flow, comprising of the spray 2 and a portion of the curtain gas 7, in the direction from the ion source 1 to the aperture 4 is desired, a substantially leak free seal is preferable. The net flow at any point between the ion source 1 and aperture 4 may be supplemented by an additional source of gas, if the gas streamlines 18, described below, remain laminar.

In operation, the electric field and the gas flow dynamics that are present in the particle discriminator cell 30 create a charged particle discrimination effect that reduces the amount of undesirable charged particles entering the aperture 4. To better understand this process, a discussion of the gas flow dynamics and the electric field effects are independently presented by the following.

Figure 3:
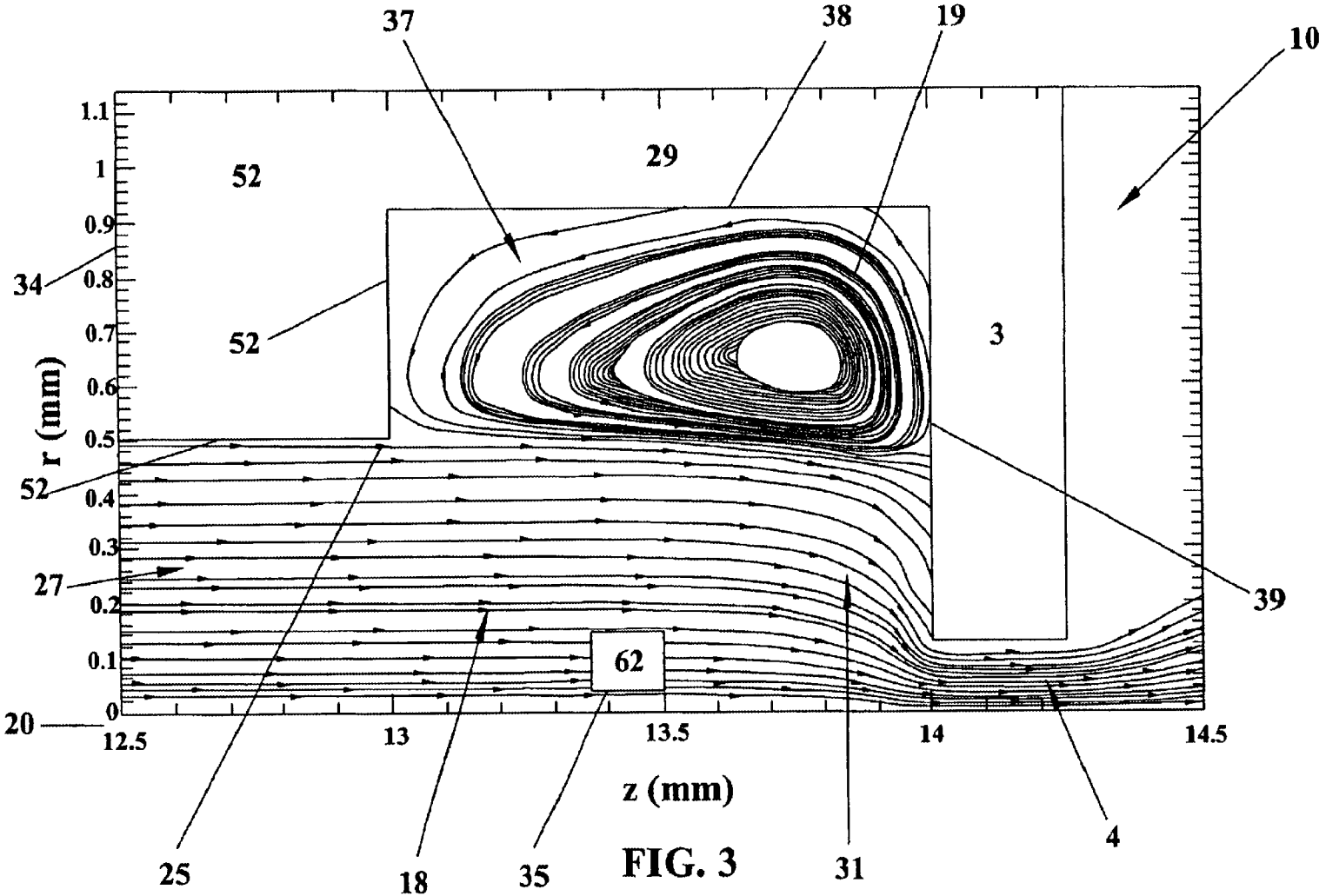
FIG. 3 is a diagrammatic view of the gas flow streamlines of the charge particle discriminator in accordance with the present invention.

First, to illustrate the gas flow dynamics, reference is made to FIG. 3, of which shows a sectional view taken along the central axis 20 showing the gas flow streamlines from a 2-dimensional computational fluid dynamic (CFD) modeling of the particle discriminator cell 30 including a portion of the desolvation cell 27. The vertical axis 34 is a measure of the distance (in mm) from the central axis 20 while the gradations on the horizontal axis 35 are measured from the inlet 24 of the heated chamber 26. The diameter of the aperture 4 is about 0.25 mm and the vacuum pressure in chamber 10 is between 1–5 mbarr. The streamlines 18 parallel to the central axis 20, are characterized as having gas flow velocity between 23 m/s near the central axis 20 and extending out in a radial direction to about 5 m/s or less near the surface 52 of the heated chamber 26. Due to the restriction of the aperture 4, the gas flowing through the aperture 4 is accelerating and the calculations indicate the instantaneous velocity is above 29 m/s. The charged particle discriminator (CPD) zone 37 is defined by the annular zone bounded between the spacer surface 38 and between the heated chamber exit surface 36 to the aperture partition surface 39. This annular discriminator zone 37 surrounds the central zone 59 (see FIG. 1) through which the bulk of the ion stream passes. Conventionally, as practiced by others, there is a heated capillary tube for droplet desolvation with either the exit of the capillary tube positioned directly adjacent to the inlet aperture of the mass spectrometer, or the capillary tube completely takes the place of the inlet aperture.

In contrast, the CPD zone 37 serves to create a radial perturbation or longitudinal discontinuity between the heated chamber exit 25 and the aperture 4, and circulating streamlines 19 are formed. The circulating streamlines 19 are typically referred to as eddies having low flow velocities, about 2 m/s, while the streamlines 18 adjacent to the CPD zone 37 tend to converge 31 towards the aperture 4 at a greater gas flow velocity. Generally, the gas flowing through the heated chamber 26 and the center of the particle discriminator cell 30 is laminar, and all the gas flow is created by the vacuum draw from the mass spectrometer 32. Ions and charged particulates are distributed across the streamlines 18 with the large and heavy charged particulates traveling with the streamlines 18 in a region radially extending beyond line-of-sight of the aperture 4, breaking free of the streamlines 18 as the streamlines converge 31, and impact the partition 3 near the aperture 4. The charged particles nearest to the CPD zone 37 break free of the converging streamlines and tends to enter the circulating streamlines 19 of the CPD zone 37 while charged particles traversing along the central axis 20 in direct line-of-sight of the aperture, enter the aperture 4. As will be described later, these line-of-sight charged particles can be blocked from entering the aperture 4. On the other hand, small charged particles traversing in the region radially beyond line-of-sight of the aperture 4 are easily influenced by the gas flow and will converge 31 through the aperture 4 and pass into the mass spectrometer 32.

However, with the appropriate electric fields, a number of surprising effects are taking place, which includes; a) charged particulates are deflected away from the aperture 4; b) heavy charged particulates that would normally be impacting adjacent to the aperture 4 are drawn towards the circulating streamlines 19; and c) ions continue to traverse through to the aperture 4. The electric fields thus have the effect of reducing the amount of deposit collected near the aperture 4 while maintaining ion transmission to the mass spectrometer.

Figure 4:
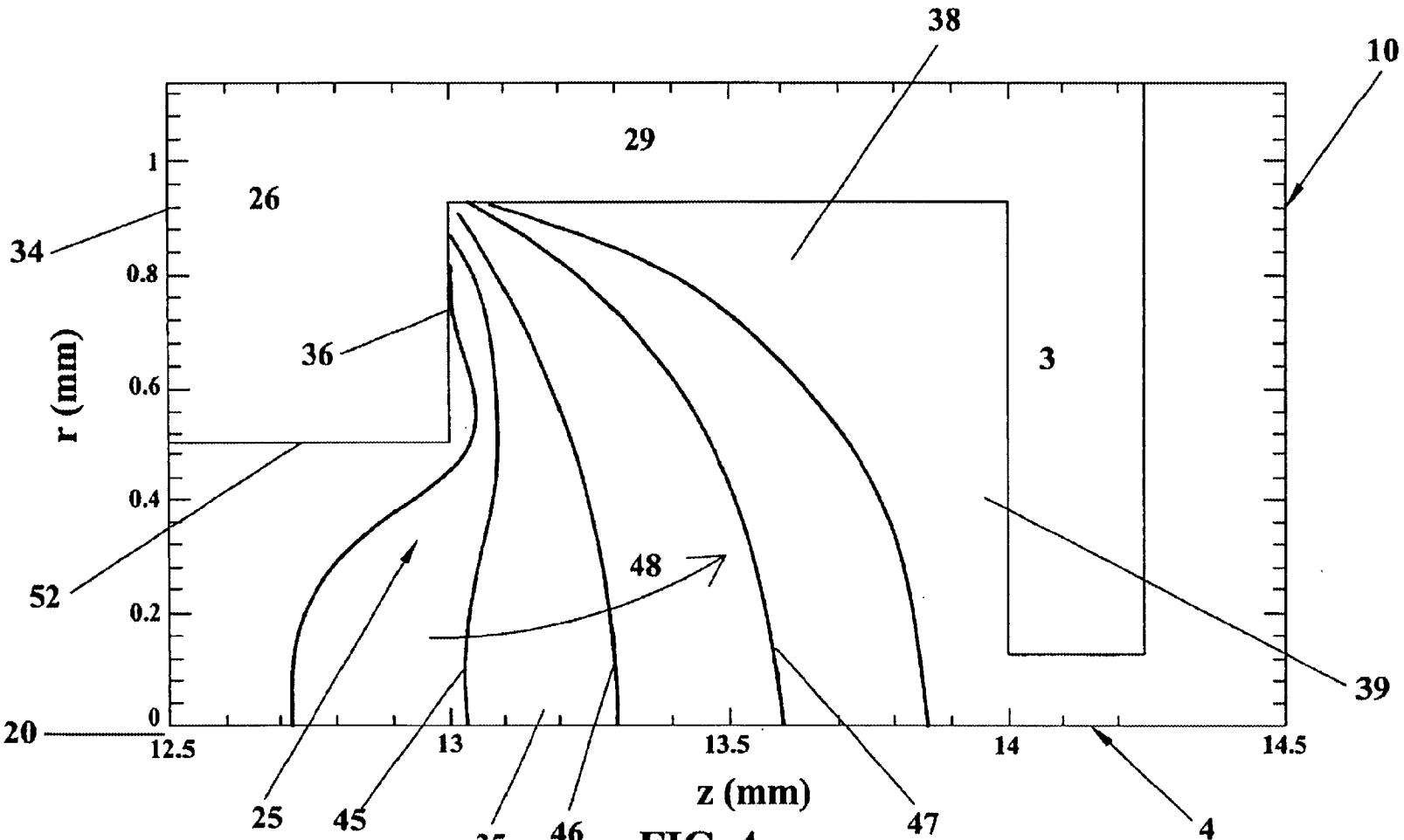
FIG. 4 is a diagrammatic view of the electric field of the charge particle discriminator in accordance with the present invention.
Figure 5:
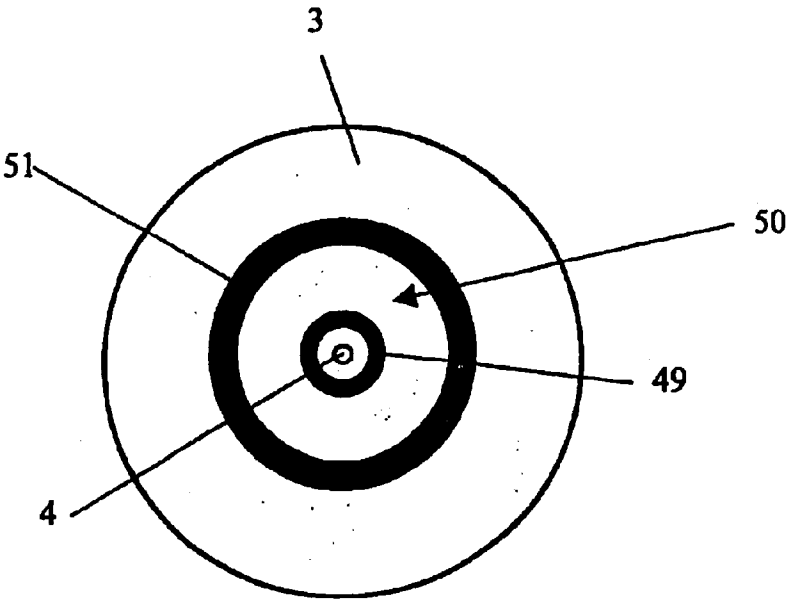
FIG. 5 is representation of the results from a charge particle discriminator of FIG. 1.

To illustrate the electric field effects, reference is now made to FIG. 4, of which shows the electric field modeling for the region described in FIG. 3. In this model, the potential on the heated chamber 26 is set at +500 volts, the potential on the partition 3 is set at +40 volts and the spacer 29 has a conductive material inset (not shown) also set at +40 volts. As previously discussed, the spacer 29 can be appropriately constructed entirely of an electrically insulating material such as ceramic where no voltage is applied. The electric field created by the voltage distribution is represented by the different lines. For example, the lines 45, 46 and 47 are equal potential lines (equipotentials), representing approximately 400, 300 and 150 volts respectively. The equipotentials indicate that the electric field diverges away from the central axis 20 towards a direction indicated by the arrow 48. Charged particles traversing in the direction from the heated chamber exit 25 towards the aperture 4 will tend to be diverted in the direction of the arrow 48. FIG. 5 is a representation of the particle discrimination evident on the partition 3. A sample of cytochrome c digest was used for the analysis. There are three distinct regions of deposit on the partition 3 located around the aperture 4. The first region 49 is comprised of a deposit of heme groups from the cytochrome c digest. This deposit, referred to as a primary deposit, may be extensively dispersed as the potential difference between the heated chamber 26 and partition 3 is increased. For instance, if the heated chamber 26 is operated at the same potential as the partition 3, the diameter of this deposit is typically about 680 μm, and if the potential difference is increased to 400 V, the diameter of this deposit is typically about 790 μm. The increased dispersion of the deposit with electric field has no effect on the protein ion count rate, which indicates that the ions are unperturbed, and are swept along with the laminar gas flow towards the aperture 4.

The second region 50 of interest corresponds to a clear area surrounding the primary deposit. This area is generated because both the gas flow streamlines and the electric field are divergent relative to the partition 3, causing the charged particles to be directed away from this area. The final region 51 contains a light monodisperse layer of material deposited from the edge of the second region 50, out to the spacer surface 38. This light dusting occurs as a result of particles that become trapped within the swirling gas flow of the circulating streamlines 19 in the CPD zone 37. The gas flow properties cause particles within this region to swirl around until they strike the partition 3 and deposit there in a uniform fashion.

Figure 6:
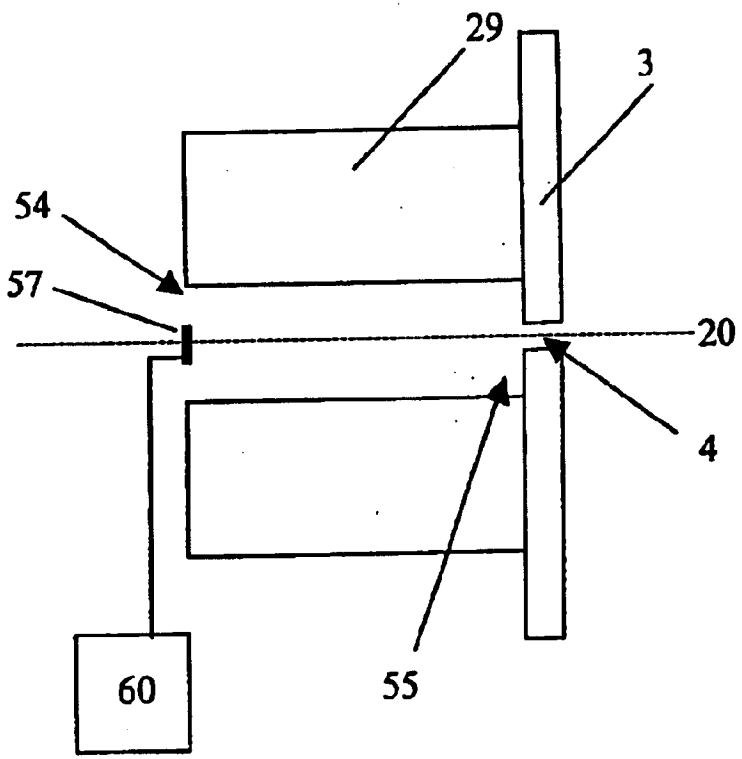
FIG. 6 is a schematic view of yet another charge particle discriminator in accordance with the present invention.
Figure 7:
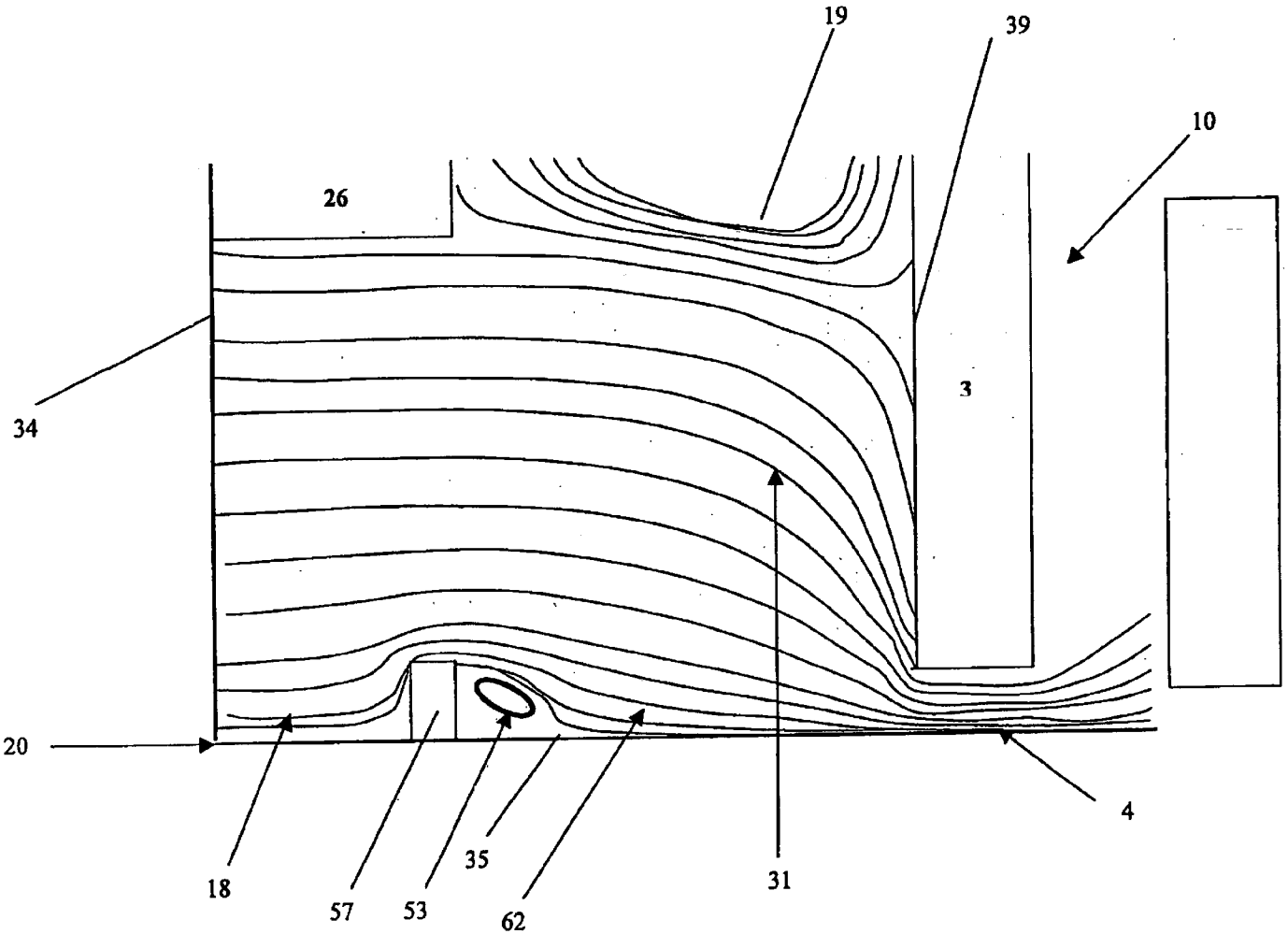
FIG. 7 is another diagrammatic view of the gas flow streamlines of the charge particle discriminator in accordance with the present invention.

In accordance with an aspect of another embodiment, FIG. 6 shows a blocking member 57 located on the central axis 20, between the heated chamber exit 25 and the exit 55 of the spacer 29 to provide charged particle discrimination by eliminating the direct line-of-sight for particles traversing along the axis 20. The diameter of the blocking member 57 is smaller than the inner diameter of the heated chamber 26 and larger than the diameter of the aperture 4. For example, a 300 μm blocking member 57 is suitable with a 2 mm heated chamber 26 bore. Generally, the blocking member 57 is larger than the diameter of the aperture 4, but the size can vary depending on the gas flow conditions passing through the heated chamber 26 and through the spacer 29. More specifically, the diameter and the positioning of the blocking member 57 with respect to the aperture 4, is chosen such that flow streamlines 18 upstream and flow streamlines 62 downstream of the blocking member 57 remain laminar, see FIG. 7, where like numerals represent like elements in FIG. 3. In addition, the streamlines 62 downstream of the blocking member 57 should have sufficiently converged back towards the central axis 20 such that the streamlines 62 will further converge into the aperture 4. It is preferable to minimize the recirculating streamlines 53 located downstream of the blocking member 57. Therefore, positioning the blocking member to provide the above conditions, larger particles will not be carried around the blocking member 57 by the gas flow. Consequently, the larger particles will impact and deposit onto the surface of the blocking member 57 while the ions flow around and enter the aperture 4. The blocking member 57 can be an electrical insulator or can be an electrically conductive element having one pole (depending on the polarity of the ions desired) of voltage sources 60 connected to it to provide an electrostatic field. The electrostatic field may further help to deflect large charged particles from the aperture 4.

Additionally, it can be appreciated that the location of blocking member 57 along the axis 20 is not limited to a position between the heated chamber exit 25 and the outlet 55 of the spacer 29. Similar results can be achieved by positioning the blocking member 57 within the bore 58 of the heated chamber 26.

Figure 8C:
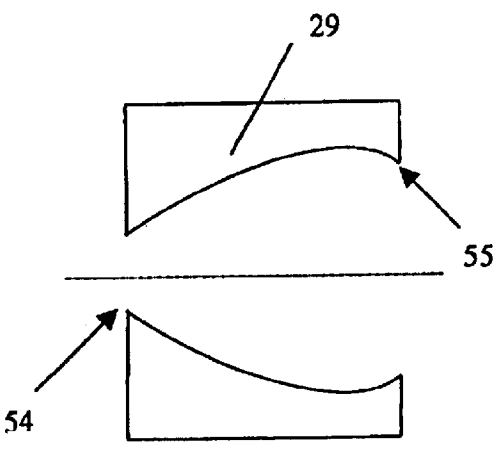
FIGS. 8A, 8B & 8C are schematic views of spacers defining the charge particle discriminator regions in accordance with the present invention.
Figure 8B:
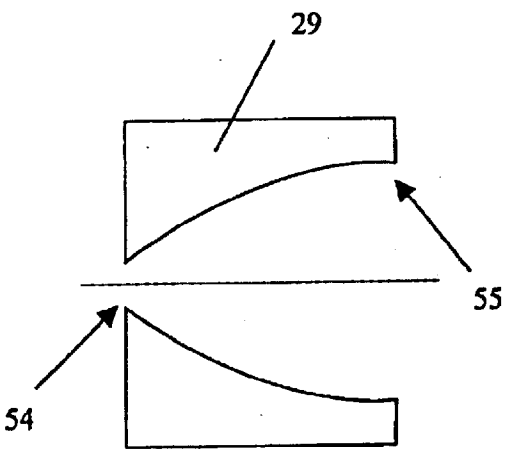
Figure 8A:
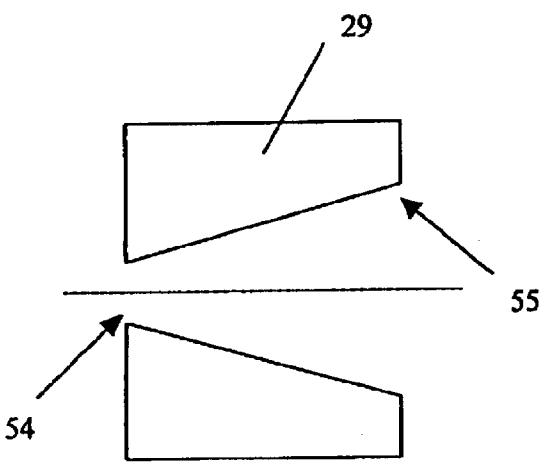
Figure 9:
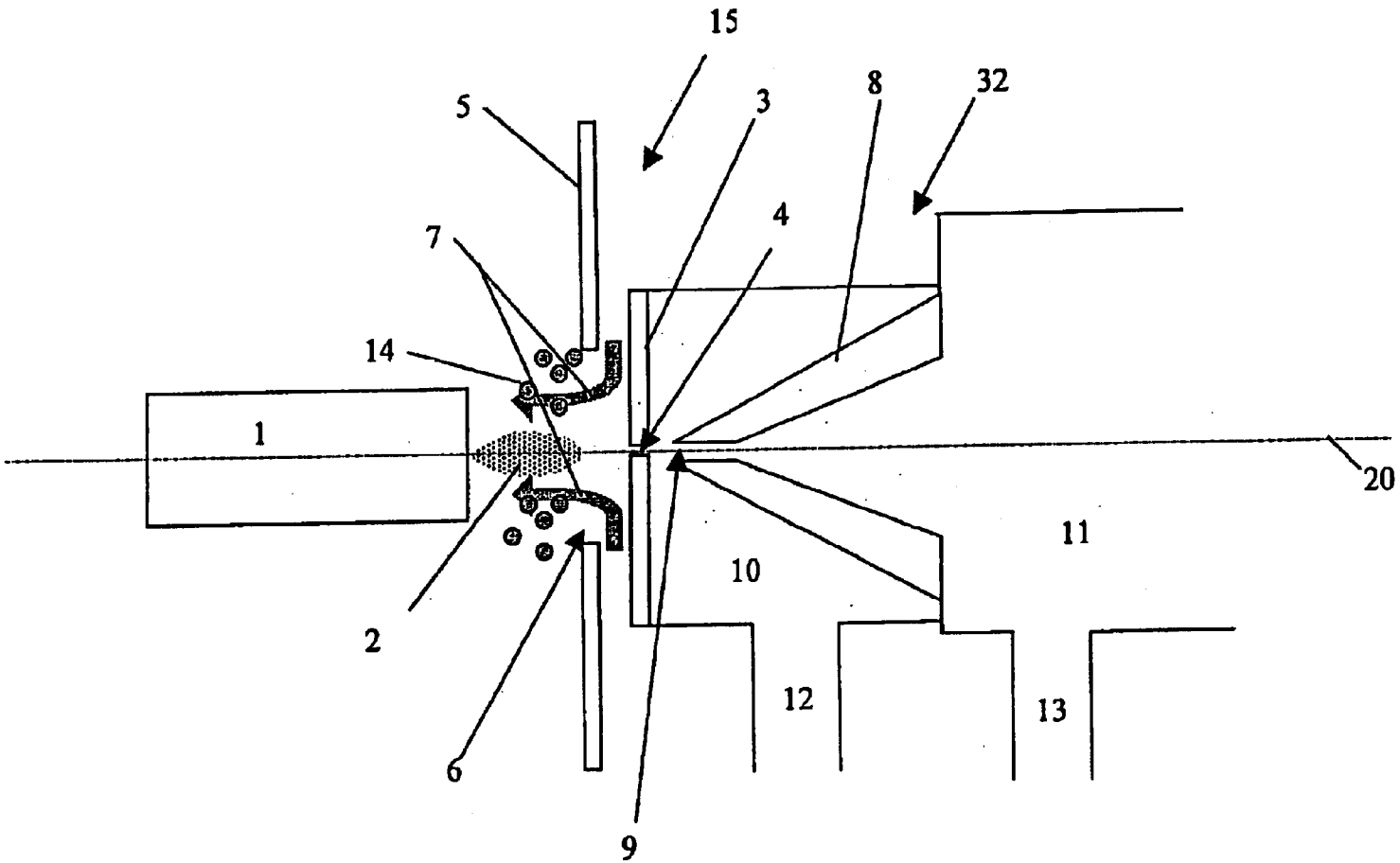
FIG. 9 (PRIOR ART)
FIG. 9 is a schematic view of conventional prior art atmospheric pressure interfaces.

From the above description, particle discrimination is achieved by a combination of electric field and gas flow contributions present within the spacer 29. The blocking member 57 removes charged particulates traversing on axis 20 in the direct line-of-sight with the aperture 4, while the electric field drives the charged particulates destined to impact the perimeter of the aperture 4 to flow into the CPD zone 37. This effect can become more pronounced by increasing the divergent nature of the electric field between the heated chamber exit 25 and the partition 3. It is also possible to vary the bore of the spacer 29 or by changing the shape of the spacer 29 to provide a larger region of circulating streamlines 19. For example, as shown in FIG. 8A, for simplicity and brevity, like parts with the apparatus of FIG. 4 are given the same reference numbers, the spacer 29 has a diameter for the outlet 55 larger than the diameter of the inlet 54 and where the transition between the inlet 54 and outlet 55 is a linear increasing bore. Additionally, as shown in FIGS. 8B and 8C, again, like reference numerals indicate like parts of FIG. 4, the inlet 54 to outlet 55 transitions can be shaped with a nonlinear profile to promote charged particle dispersion.

In a preferred embodiment illustrated in FIG. 1, the spacer 29 is made of a nonconductive material, electrically isolating the heated chamber 26 from the partition 3. When the spacer 29 is electrically conductive, or partially conductive, connected to voltage source 42 and electrically isolated from the heated chamber 26 and from the partition 3, an electric field in the CPD zone 37 can be created to provide a radial mobility field. The mobility field can divert charged particles away from the aperture 4 in the radial direction, indicated by the arrows 56 in FIG. 1. For example, by applying the appropriate potential to the spacer surface 38 so that a negative potential field is created in the CPD zone 37, positively charged particles are attracted towards the spacer surface 38 and away from the aperture 4. The magnitude of the negative potential should be optimized to prevent extraction of high mobility charged ions from the gas flow stream. Similarly, to detract negatively charged particles from the aperture 3, a positive potential field can be created.

Additionally, an inverse mobility chamber can be created by applying the appropriate potentials to the heated chamber 26, spacer 29 and partition 3 so that the charged particle's mobility is directed towards the heated chamber exit surface 36. For example, the ion source 1 has a potential of +2000 volts, both the curtain plate 5 and heated chamber 26 have 0 volts, the spacer 29 is non conductive and the partition 3 is supplied with a potential of +30 volts. This combination of potentials generates an axially repellant electric field thereby preventing large charged particles from striking the aperture 3 while not affecting the count rate for ions. The selection of the potentials in the combination would depend on the diameters of the bore 58 and the bore 59, and to some extent the aperture 4. It is conceivable that with the appropriate combination of potentials, both ions and particulates can be diverted away from the aperture 4 to provide a convenient method of interrupting the stream of ions directed to the mass spectrometer. Similarly, reversing the polarity on the ion source 1 and partition 3 will repel negatively charged particles from the aperture 3. This is a significant advantage over the prior art because it substantially improves robustness, by decreasing contamination through the aperture thereby maintaining the gas conductance limit into the mass spectrometer.

While preferred embodiments of the invention have been described, it will be appreciated that changes may be made within the spirit of the invention and all such changes are intended to be included in the scope of the claims.

What is claimed is:

1. A system for ion mass spectroscopy comprising:

an ion source disposed in atmospheric pressure;

a mass spectrometer;

a vacuum chamber containing the mass spectrometer;

an ion interface disposed between the ion source and the vacuum chamber for introducing ions generated by the ion source into the vacuum chamber for analysis by the mass spectrometer, the ion interface comprising an entrance cell and a particle discrimination cell, the entrance cell having a bore disposed to receive output of the ion source to form an ion stream containing analyte ions and undesirable particulates, the particle discrimination cell having a bore disposed downstream of the bore of the entrance cell and upstream of an aperture in a partition separating atmospheric pressure from the vacuum chamber, the bore of the particle discrimination cell having a central zone and a discrimination zone surrounding the central zone and being sized larger than the bore of the desolvation cell to cause formation of eddies in the discrimination zone when the ion stream flows from the bore of the entrance cell into the bore of the particle discrimination cell, the particle discrimination cell having a voltage applied thereto for generating a discrimination electric field in the bore thereof, whereby the discrimination electric field and the formation of eddies in the particle discrimination cell together provide an effect of removing a portion of the undesirable particulates from the ion stream prior to entering the vacuum chamber through the aperture of the partition.

2. A system for ion mass spectroscopy as in claim 1, wherein the ion interface includes a heater for heating the entrance cell.

3. A system for ion mass spectrometer as in claim 1, wherein the ion interface further includes a curtain plate disposed downstream of the ion source for providing a curtain gas flow in a reverse direction to the output of the ion source.

4. A system for ion mass spectroscopy as in claim 1, wherein the ion source is an electrospray source generating a spray of charged droplets, and wherein ion interface includes a heater for heating the entrance cell for drying the spray as the charged droplets pass through the bore of the entrance cell.

5. A system for ion mass spectroscopy as in claim 4, further including a curtain plate disposed between the electrospray source and the entrance cell for providing a curtain gas flow in a reverse direction to the spray.

6. A system for ion mass spectroscopy as in claim 1, wherein the ion source is a matrix-assisted laser desorption/ionization (MALDI) source generating a plume of ions.

7. A system for ion mass spectroscopy as in claim 6, further including a curtain plate disposed between the MALDI source and the entrance cell for providing a curtain gas flow in a reverse direction to the plume.

8. A system for ion mass spectroscopy as in claim 1, wherein the bore of the entrance cell has a diameter between 0.75–3 mm and the bore of the particle discrimination chamber has a diameter between 2–20 mm.

9. A system for ion mass spectroscopy as in claim 1, wherein the ion interface further includes a blocking member located inside the bore of the particle discrimination cell.

10. A system for ion mass spectroscopy as in claim 9, wherein the blocking member is located on an axis of the bore of the particle discrimination cell.

11. A method of interfacing an ion source operating in atmospheric pressure with a mass spectrometer contained in a vacuum chamber, comprising:

directing output of the ion source into a bore of an entrance cell to generate an ion stream, the ion stream containing analyte ions and undesirable particulates, and passing the ion stream into a bore of a discrimination cell disposed downstream of the desolvation cell and upstream of an aperture of a partition separating atmospheric pressure from the vacuum chamber, the bore of the discrimination cell having a central zone and a discrimination zone surrounding the central zone and being sized greater than the bore of the desolvation cell to cause formation of eddies in the discrimination zone when the ion stream flows from the desolvation cell into the discrimination cell; and applying a voltage to the discrimination cell to generate a discrimination electric field in the bore of the discrimination cell, whereby the discrimination electric field and generation of eddies in the discrimination cell together provide an effect of removing a portion of the undesirable particulates from the ion stream prior to entering the vacuum chamber through the aperture of the partition.

12. A method as in claim 11, wherein the ion source is an electrospray source for generating a spray of charged droplets, the method further including the step of heating the entrance cell for drying the spray as the charged droplets pass through the bore of the entrance cell.

13. A method as in claim 12, further including the step of providing a flow of gas in a reverse direction of the spray to assist desolvation of the spray.

14. A method as in claim 11, wherein the ion source is a matrix-assisted laser desorption/ionization (MALDI) source.

15. An ion interface for interfacing an ion source disposed in atmosphere pressure and a mass spectrometer contained in a vacuum chamber, comprising:

an entrance cell disposed to receive output of the ion source to form an ion stream containing analyte ions and undesirable particulates; and a particle discrimination cell having a bore disposed downstream of the bore of the entrance cell and upstream of an aperture in a partition separating atmospheric pressure from the vacuum chamber, the bore of the particle discrimination cell having a central zone and a discrimination zone surrounding the central zone and being sized larger than the bore of the desolvation cell to cause formation of eddies in the discrimination zone when the ion stream flows from the bore of the entrance cell into the bore of the particle discrimination cell, the particle discrimination cell having a voltage applied thereto for generating a discrimination electric field in the bore thereof, whereby the discrimination electric field and the formation of eddies in the particle discrimination cell together provide an effect of removing a portion of the undesirable particulates from the ion stream prior to entering the vacuum chamber through the aperture of the partition.

16. An ion interface as in claim 15, further including a heater for heating the entrance cell.

17. A ion interface as in claim 15, further including a curtain plate disposed downstream of the ion source for providing a curtain gas flow in a reverse direction to the output of the ion source.

18. An ion interface as in claim 15, wherein the ion source is an electrospray source generating a spray of charged droplets, and wherein the ion interface includes a heater for heating the entrance cell for drying the spray as the charged droplets pass through the bore of the entrance cell.

19. An ion interface as in claim 18, further including a curtain plate disposed between the electrospray source and the entrance cell for providing a curtain gas flow in a reverse direction to the spray.

20. An ion interface as in claim 15, wherein the ion source is a matrix-assisted laser desorption/ionization (MALDI) source.

21. An ion interface as in claim 15, wherein the bore of the entrance cell has a diameter between 0.75–3 mm and the bore of the particle discrimination chamber has a diameter between 2 to 20 mm.

22. An ion interface as in claim 15, wherein the ion interface further includes a blocking member located inside the bore of the particle discrimination cell.

23. An ion interface as in claim 22, wherein the blocking member is located on an axis of the bore of the particle discrimination cell.

* * * * *